US008360540B2

(12) United States Patent
Ito

(10) Patent No.: US 8,360,540 B2
(45) Date of Patent: Jan. 29, 2013

(54) RECORDING APPARATUS

(75) Inventor: Takashi Ito, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 145 days.

(21) Appl. No.: 13/076,178

(22) Filed: Mar. 30, 2011

(65) Prior Publication Data

US 2011/0310139 A1 Dec. 22, 2011

(30) Foreign Application Priority Data

Jun. 17, 2010 (JP) ..... 2010-138445

(51) Int. Cl.
*B41J 29/38* (2006.01)

(52) U.S. Cl. ..... 347/6; 347/65; 347/93

(58) Field of Classification Search ..... 347/5, 6, 347/66, 70–72, 84–87, 92–93
See application file for complete search history.

(56) References Cited

U.S. PATENT DOCUMENTS 4,611,219 A * 9/1986 Sugitani et al. ..... 347/65
7,311,380 B2 * 12/2007 Watanabe et al. ..... 347/40

FOREIGN PATENT DOCUMENTS

JP 2007-203641 A 8/2007

* cited by examiner

*Primary Examiner* — Juanita D Jackson
(74) *Attorney, Agent, or Firm* — Baker Botts L.L.P.

(57) ABSTRACT

A recording apparatus of the present invention includes: a recording head having ejection openings which eject liquid, a liquid supply unit which supplies the liquid to the recording head, and a supply control unit which controls the liquid supply unit. The recording head includes: a liquid supply portion and first and second discharge portions; a first passage connecting the supply portion and the first discharge portion; a second passage which branches off from the first passage and communicates with the second discharge portion; a supply passage which branches off from the second passage and which supplies the liquid to the ejection openings; and a first filter disposed nearby a position at which the second passage branches off from the first passage, which filtrates the liquid flowing from the first passage to the second passage.

8 Claims, 8 Drawing Sheets

RECORDING APPARATUS

CROSS REFERENCE TO RELATED APPLICATION

The present application claims priority from Japanese Patent Application No. 2010-138445, which was filed on Jun. 17, 2010 the disclosure of which is herein incorporated by reference in its entirety.

BACKGROUND OF THE INVENTION

As an example of traditional recording heads, there is one having an ink passage with a passage for supplying ink to an ejection opening which ejects ink; and a passage for discharging ink from that ink passage to the outside the recording head. Further, there has been a structure in which a filter for filtrating liquid such as ink is provided in a passage of a recording head.

SUMMARY OF THE INVENTION

To provide to a passage in a head a filter for filtrating liquid such as ink, a passage for removing air bubbles accumulated on the filter is provided in the head. For example, such a passage extends from a supply portion to which liquid is supplied from outside the head to a discharge portion from which the liquid is discharged outside the head. By supplying the liquid from the liquid supply portion to the discharge portion, air bubbles accumulated on the filter are washed away. Removal of air bubbles by supplying liquid however often encounters difficulties in washing away the air bubbles in such a manner as to go through the filter. To appropriately remove the air bubbles at the both upstream and downstream of the filter, there is a need of suitably forming at the upstream and the downstream of the filter a passage for washing away the air bubbles, and a need for suitably supplying a liquid in the passage.

An object of the present invention is to provide a recording apparatus capable of suitably removing foreign materials such as air bubbles inside a recording head.

To this end, a recording apparatus of the present invention includes: a recording head having ejection openings from which liquid is ejected; a liquid supply unit which supplies liquid to the recording head; and a supply control unit which controls the liquid supply unit. The recording head includes: a liquid supply portion and first and second discharge portions; a first passage connecting the supply portion and the first discharge portion; a second passage which branches off from the first passage and communicates to the second discharge portion; a supply passage which branches off from the second passage and which supplies the liquid to the ejection openings; and a first filter disposed nearby a position at which the second passage branches off from the first passage, which filtrates the liquid flowing from the first passage to the second passage. The supply control unit controls the liquid supply unit so as to start a second liquid flow forming operation after a first liquid flow forming operation is started, the first liquid flow forming operation being a process which supplies the liquid from the supply portion to the first passage and discharge from the discharge portion; and the second liquid flow forming operation being a process which supplies the liquid from the supply portion to the first passage and discharge the liquid from the second discharge portion via the second passage.

DESCRIPTION OF THE PREFERRED EMBODIMENTS

The following describes a preferable embodiment of the present invention, with reference to attached drawings.

Figure 1:
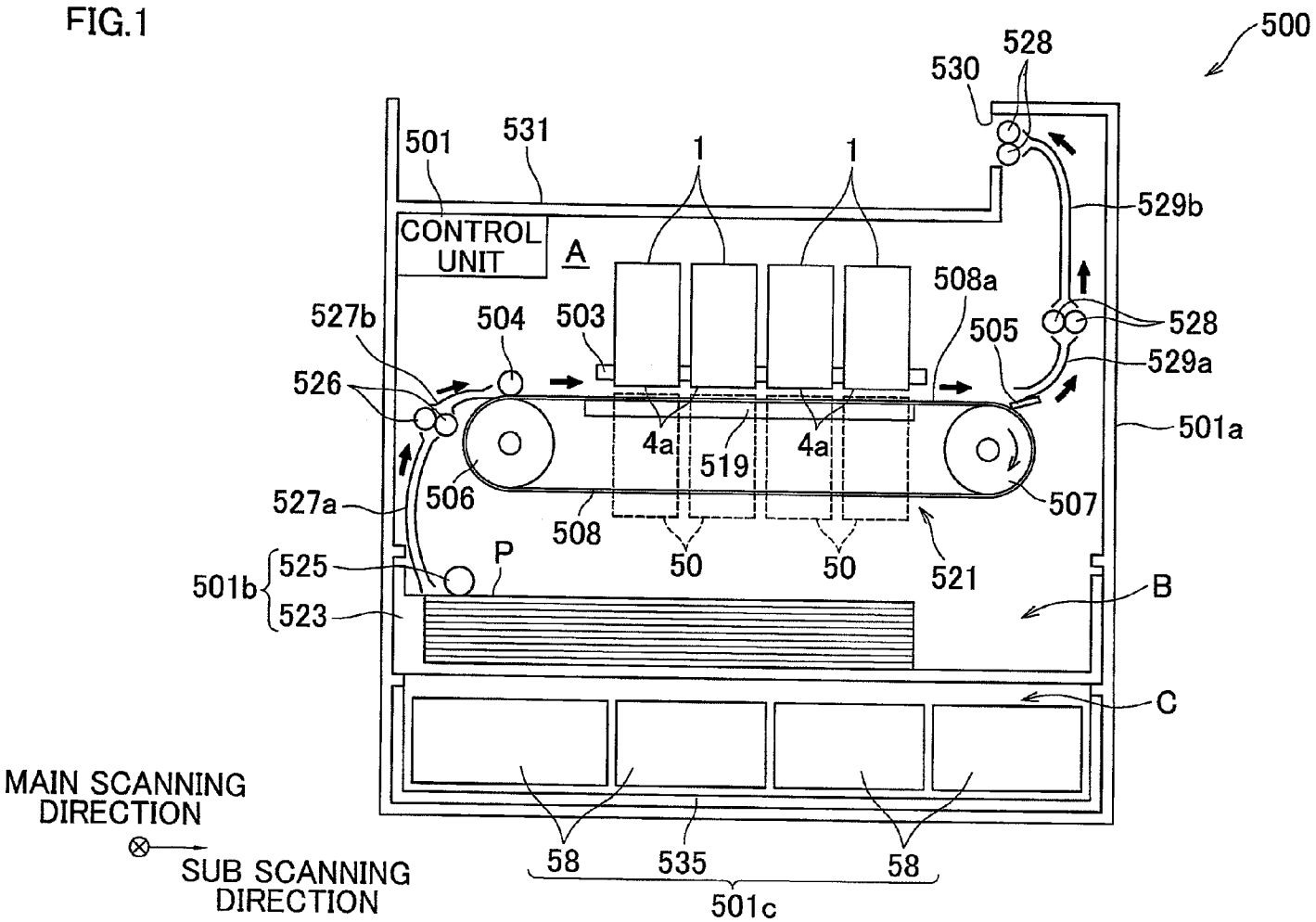
FIG. 1 is a schematic side view showing an interior structure of an inkjet printer of one embodiment, according to the present invention.

First described with reference to FIG. 1 is an overall structure of an inkjet printer of one embodiment, according to the present invention. As shown in FIG. 1, the inkjet printer 500 includes heads 1 each of which is a line head made long in one direction (a direction perpendicular to the sheet surface of FIG. 1). Each head 1 is built in the inkjet printer 500 so that the length of the head 1 is parallel to a main scanning direction. The printer 500 is a line color inkjet printer.

The printer 500 has a casing 501*a* having a rectangular parallelepiped shape. On top of the ceiling plate of the casing 501*a* is provide a sheet output unit 531. The interior space of the casing 1*a* is divided into spaces A, B, and C in this order from the top. In the spaces A and B is formed a sheet conveyance path connected to the sheet output unit 531. A sheet P is conveyed an subjected to image formation in the space A. In the space B is performed an operation related to sheet feeding. The space C stores main tanks 58 each serving as an ink supply source.

The space A accommodates therein four heads 1, ink supply units 50 which supply ink to the heads 1, a conveyance unit 521 which conveys a sheet P, and a guide unit or the like which guides the sheet P. At the top of the space A is disposed a controller 501 which administrates operations of the entire printer 500 by controlling various operations of parts in the printer 500.

Each head 1 has substantially a rectangular parallelepiped shape which is longer in the main scanning direction. The four heads 1 are aligned at a predetermined pitch in a sub scanning direction, and are supported by the casing 501*a* via a head frame 503. The four heads 1 eject from their under surfaces (ejection faces) 4*a* droplets of Magenta ink, Cyan ink, Yellow ink, and Black ink respectively towards a sheet P being conveyed, respectively. Each of the ink supply units 50 supplies ink from the corresponding one of the main tanks 58 to the corresponding one of the heads 1. The structures of the heads 1 and the ink supply units 50 are detailed later.

The conveyance unit 521 includes: two belt rollers 506 and 507, an endless conveyor belt 508 looped around the both rollers 506 and 507, a nip roller 504 and a separation plate 505 disposed outside the loop formed by the conveyor belt 508; and a platen 519 disposed inside the loop formed by the conveyor belt 508. The belt roller 507 is a drive roller whose rotation is driven by a conveyance motor under control of the controller 501. The belt roller 507 rotates clockwise in FIG. 1. With the rotation of the belt roller 507, the conveyor belt 508 runs in a direction indicated by the arrows in FIG. 1. The belt roller 506 is a driven roller and is rotated clockwise in FIG. 1 by the movement of the conveyor belt 508. The nip roller 504 is disposed to face the belt roller 506, and presses a sheet P supplied through a later-described upstream guide unit against the outer circumference 508*a* of the conveyor belt 508. On the outer circumference 508*a* is formed a slightly adhesive silicon layer. The separation plate 505 is disposed to face the belt roller 507, and separates a sheet P from the outer circumference 508*a* and sends the sheet P to a later-described downstream guide unit. The platen 519 is disposed to face the four heads 1 across the conveyor belt 508, and supports the upper part of the loop formed by the conveyor belt 508 from the inner circumference. This way, a predetermined space suitable for image formation is formed between the outer circumference 508*a* and the ejection face 4*a* of each head 1.

The guide unit is disposed on both sides of the conveyance unit 521. The upstream guide unit includes two guides 527*a* and 527*b* and a pair of feed rollers 526. This guide unit connects a later mentioned sheet-feeder unit 501*b* and the conveyance unit 521. The downstream guide unit includes two guides 529*a* and 529*b* and two pairs of feed rollers 528. The guide unit connects the conveyance unit 521 to the sheet output unit 531.

In the space B is disposed the sheet-feeder unit 501*b*. The sheet-feeder unit 501*b* includes a sheet-feeder tray 523 and a sheet feeding roller 525, and the sheet-feeder tray 523 is detachable from the casing 501*a*. The sheet-feeder tray 523 is a box whose top is opened, and stores a plurality of sheets P. The sheet feeding roller 525, under control of the controller 501, feeds out the uppermost one of sheets P in the sheet-feeder tray 523, and supplies the sheet P to the upstream guide unit.

In the spaces A and B is formed a sheet conveyance path which extends from the sheet-feeder unit 501*b* to the sheet output unit 531 via the conveyance unit 521. The controller 501 feeds out a sheet P from the sheet-feeder tray 523 based on a record command. The sheet P is feeded to the conveyance unit 521 via the upstream guide unit. When the sheet P moves in the sub scanning direction and pass immediately below the ejection face 4*a* of each head 1, ink droplets are successively ejected from the head 1, thus forming a desirable color image on the sheet P. After that, the sheet P is separated by the separation plate 505 from the outer circumference 508*a*, and is output to the sheet output unit 531 through the downstream guide unit.

Note that the sub scanning direction is parallel to the direction in which a sheet P is conveyed by a conveyance unit 521, and the main scanning direction perpendicularly crosses the sub scanning direction along the horizontal plane.

In the space C is disposed a tank unit 501*c* in such a manner as to be detachable from the casing 501*a*. The tank unit 501*c* has a tray 535 and four main tanks 58. The four main tanks 58 are associated with the four heads 1 on one-to-one basis, and are aligned parallel to each other in the sub scanning direction, in the tray 535.

Figure 2:
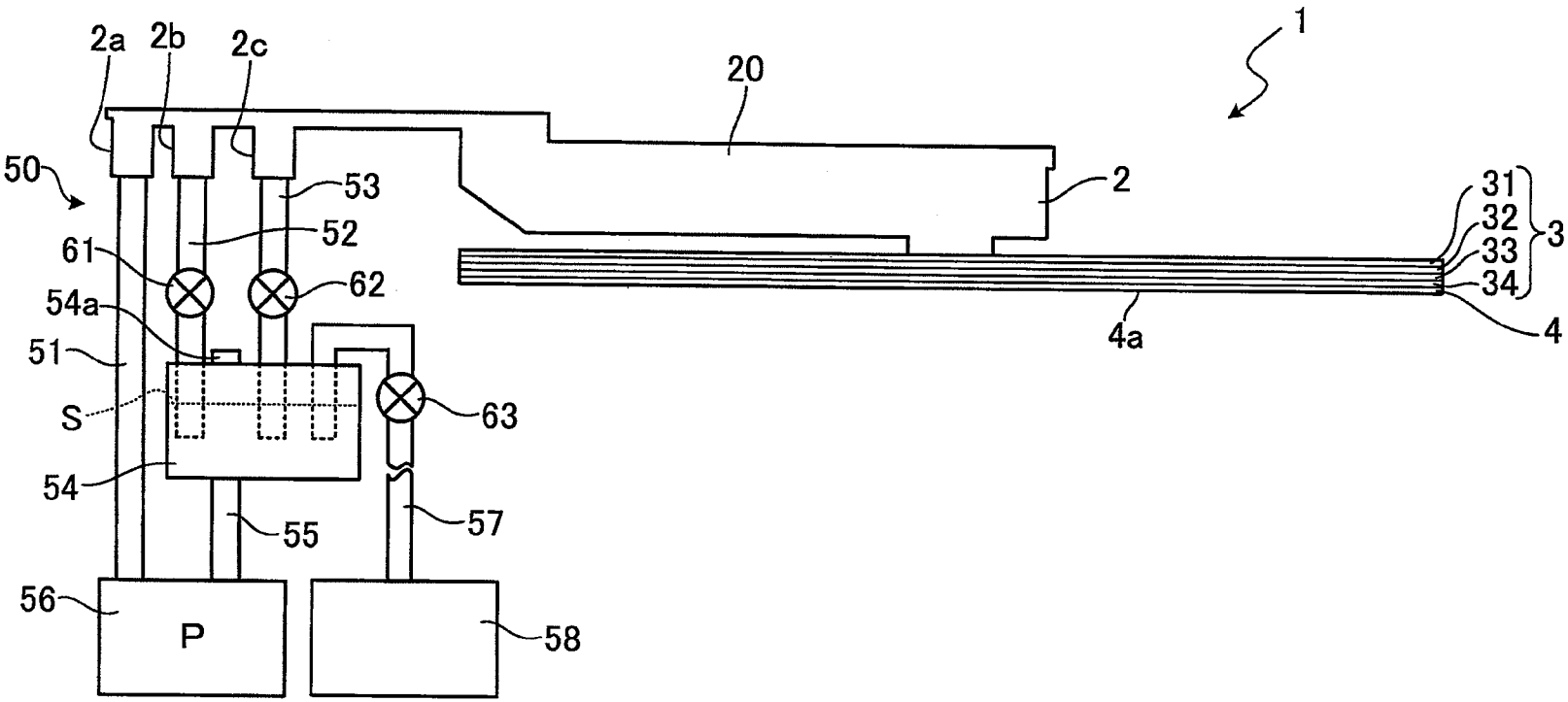
FIG. 2 is a side view showing an inkjet head shown in FIG. 1 and an ink supply unit which supplies ink to the head.

Next, the following describes the structure of the heads 1 and the ink supply unit 50 with reference to FIG. 2, FIG. 3A and FIG. 3B, and FIG. 4. As shown in FIG. 2, each head 1 has a filter unit 2, a reservoir unit 3 and a passage unit 4, in this order from the top. Inside the head 1 is formed a passage for purging, in addition to the passage of ink for recording.

Note that the purging is a process of removing foreign materials in the head 1 such as air bubbles, in which process ink is forcedly discharged to the outside the head 1. In the present embodiment, purging includes: circulation purging (see FIG. 6B) involving circulation of a liquid within an upstream portion of a filter, an inter-filter purging (see FIG. 7A) in which circulation occurs through two filters, and nozzle purging (FIG. 7B) which involves ink ejection from the ejection opening 4*y*.

The ink supply unit 50 has a sub tank 54 and a pump 56, and supplies ink from the main tank 58 to the corresponding head 1 (filter unit 2). The sub tank 54 pools ink therein, and let go of the air bubbles in the ink through a hole 54*a*. The sub tank 54 is connected to the filter unit 2 via elastic tubes 52 and 53, and is connected to the main tank 58 via an elastic tube 57. The respective end portions of the elastic tubes 52, 53, and 57 are disposed below a liquid surface S of the liquid pooled in the sub tank 54. The pump 56 is connected to the filter unit 2 and the sub tank 54 via elastic tubes 51 and 55. The pump 56, under control of the controller 501, takes the ink into the sub tank 54 via the elastic tube 55, and supplies the in-taken ink to the filter unit 2 via the elastic tube 51 and joint 2*a*.

To the elastic tubes 52, 53, and 57 are provided open/close valves 61, 62, and 63, respectively. Each of these open/close valves 61, 62, and 63 is for switching between an open state which allows ink to flow inside the tube and a closed state which prohibits the flow of ink inside the tube. When the open/close valve 61 or 62 is in the open state, the following circulation path is formed. Namely, the ink flows from the sub tank 54 into the filter unit 2 via the pump 56. Then, the ink flows out from the filter unit 2 into the sub tank 54 via the open/close valve 61 or 62 in the open state. With the above pump drive, ink contaminated by foreign materials such as air bubbles, dust, or the like is discharged from the filter unit 2 to the sub tank 54. Activating the pump 56 while the open/close valve 63 is in the open state supplies the ink from the main tank 58 to the sub tank 54. The respective states of the open/close valves 61 to 63 are controlled and switched by the controller 501.

The filter unit 2 is formed in one piece by using a material such as resin. The filter unit 2 has: a connect part having, at one end relative to the length thereof, three joints 2*a*, 2*b*, and 2*c*; and a base 20 (see FIG. 3A) having a filter 2*f* at the other end of the filter unit 2 relative to the length. Each of the joints 2*a* to 2*c* is a cylindrical protrusion. When facing the ejection face 4*a* vertically downward, the leading end of the protrusion faces downward. To the joints 2*a* to 2*c* are attached elastic tubes 51, 52, and 53, respectively.

Specific structure of the filter unit 2 and how the ink flows inside each head 1 at the time of recording and at the time of purging are detailed later.

Figure 3B:
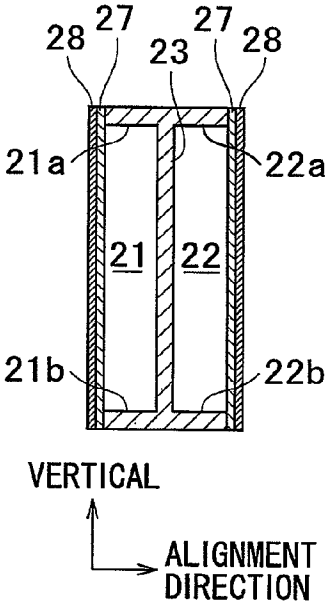
FIG. 3B is a cross sectional view taken along the line B-B of FIG. 3A.
Figure 3A:
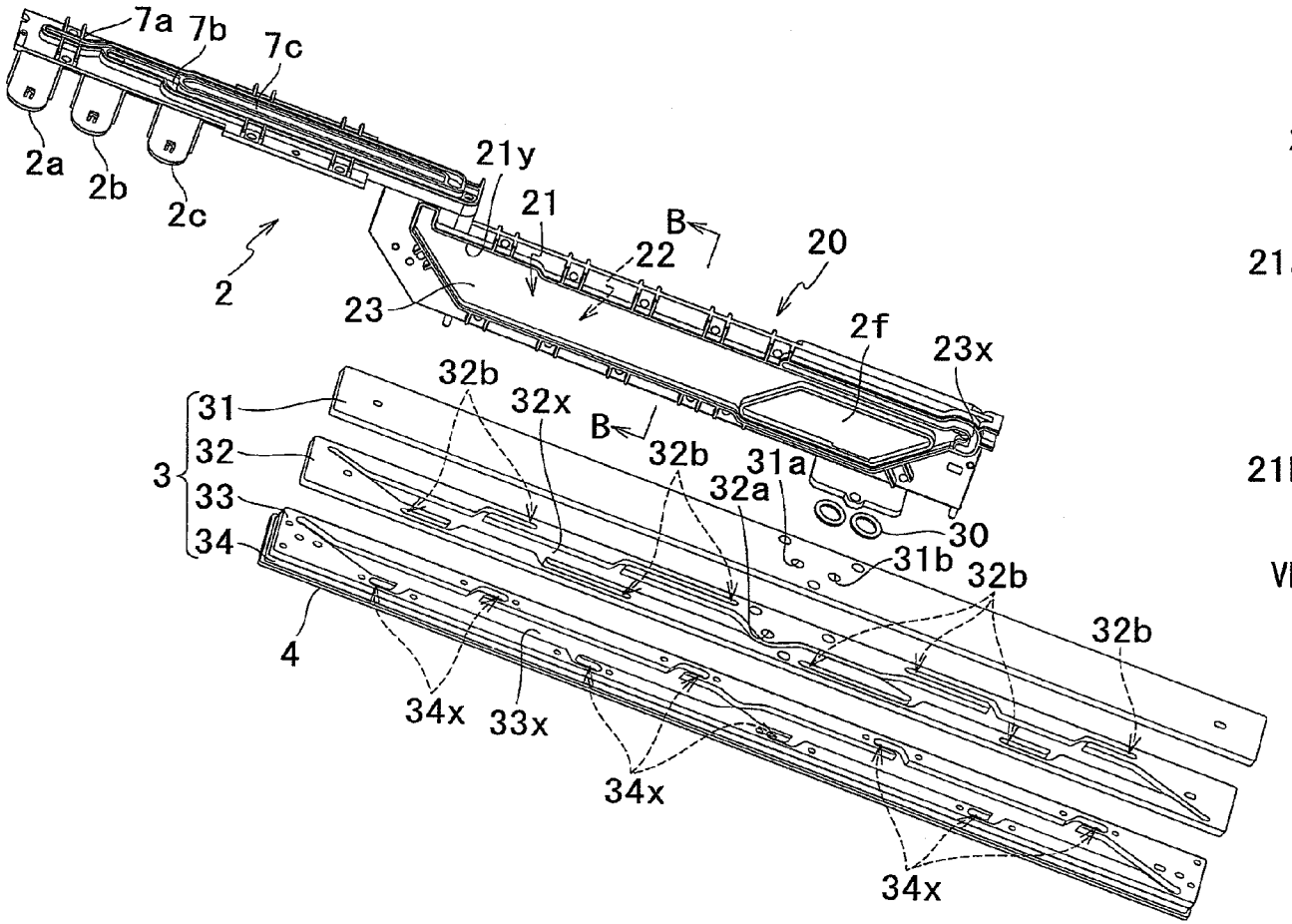
FIG. 3A is an exploded perspective view of the inkjet head shown in FIG. 1.

The reservoir unit 3 is formed by four rectangular metal plates 31 to 34 having substantially the same size in plan view, which plates are stacked and adhered to each other. As shown in FIG. 3A, the reservoir unit 3 is liquid tightly fixed to the filter unit 2 by using two O-rings 30 made of an elastic material such as rubber, and a suitable fixing member.

On the plates 31 to 34 of the reservoir unit 3 are formed through holes and recesses structuring ink passages. Specifically, the plate 31 at the uppermost layer has two through holes 31*a* and 31*b*. The plate 32 at the second layer from the top has a through hole 32*a* corresponding to the through hole 31*a*, and a recess 32*x* corresponding to the through hole 31*b*. The recess 32*x* has branch passages. At the leading end of each branch passage is formed a through hole 32*b*. The recess 32*x* is formed on the top surface of the plate 32 and extends parallel to the length of the head. This recess 32*x* forms a space into which ink to return to the filter unit 2 flows in at the time of a later-described inter-filter purging (see FIG. 7A). The plate 33 which is the third from the top has a reservoir 33*x* for temporarily pooling the ink. The reservoir 33*x* penetrates the plate 33 in a direction parallel to the thickness, and extends in a direction parallel to the length of the head. The center portion of the reservoir 33*x* relative to the length thereof faces the through hole 32*a*. To this reservoir, the ink from the filter unit 2 flows in. Further, the reservoir 33*x* has branch passages, and the leading end of each branch passage faces the through hole 32*b* and a opening 4*a* (see FIG. 4) of the passage unit 4. Note that, except for the leading ends of the branch passages which form communicating portion between the through hole 32*b* and the opening 4*a*, the reservoir 33*x* is closed by the under surface of the plate 32 covering the top of the reservoir 33*x* and the top surface of the plate 34 covering the bottom of the reservoir 33*x*. The plate 34 at the lower most layer has through holes 34*x* facing the openings 4*x*. In the present embodiment, the openings 4*x*, the through holes 34*x*, the leading ends of the branch passages of reservoir 33*x*, and the through holes 32*b* are disposed substantially linearly relative to the direction in which the plates are stacked. When the ejection face 4*a* is faced downwards, the air bubbles if any hardly move toward the passage unit 4, because of an emerging force acting on the air bubbles keeps them away from the lower most openings 4*x*.

As is understood from the above, the reservoir unit 3 has: a passage communicating the through hole 31*a* connected to the filter unit 2 with the through holes 31*b* connected to the filter unit 2, via the leading ends of the branch passages of the reservoir 33*x*; and a passages each branched off from the leading end of a branch passage of the reservoir 33*x* and communicating to the through hole 34*x* connecting to the passage unit 4 (openings 4*x*). Thus, the leading ends of each branch passage of the reservoir 33*x* serves as a branch part of a second passage and a supply passage. The part of the passage from the through hole 31*a* to the leading end of each branch passages of the reservoir 33*x* is a common passage for recording, inter-filter purging, and nozzle purging. The part of the passage from the leading end of each branch passage of the reservoir 33*x* to the through hole 31*b* is a passage for the inter-filter purging. The part of passage from the leading end of each branch passage of the reservoir 33*x* to the through hole 34*x* is a common passage for recording and nozzle purging.

Figure 4:
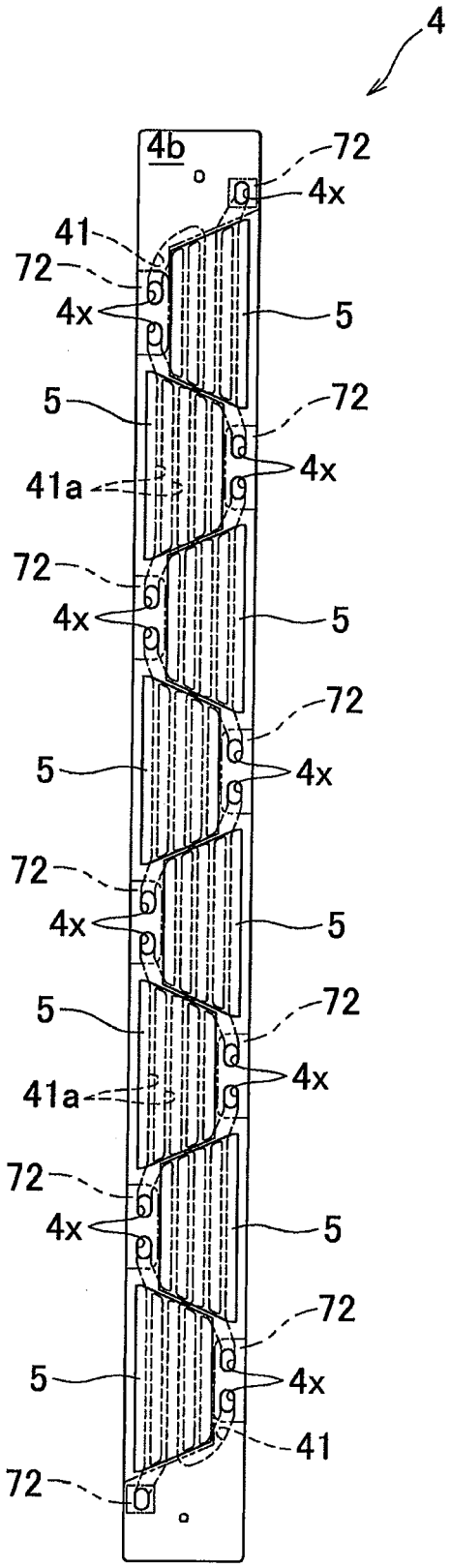
FIG. 4 is a plan view showing a passage unit in the inkjet head shown in FIG. 1.

As shown in FIG. 4, the passage unit 4 has eight actuator units 5 having a trapezoid shape. These actuator units 4 are disposed in a zigzag manner in two lines on a top surface 4*b*. On the top surface of the actuator unit 5 is attached a flexible printed circuit board which supplies drive signals from the controller 501. The openings 4*x* are formed on the top surface 4*b*, avoiding the area where the actuator units 5 are disposed. The top surface 4*b* is covered by the filter 72. The filter 72 is fixed between the under surface of the reservoir unit 3 and the top surface 4*b* of the passage unit 4, and communicates the through holes 34*x* with the openings 4*x*. The filter 72 is a plate-like member disposing a mesh material, and filtrates the ink flowing from the reservoir unit 3 into the passage unit 4. The filter 72 is thicker than the actuator unit 5 and the flexible printed circuit board, and also serves as a spacer to ensure a space for the actuator units 5 and the flexible printed circuit board, between the reservoir unit 3 and the top surface 4*b* of the passage unit 4.

Each area of the under surface 4*a* (see FIG. 2) of the passage unit 4 corresponding to the actuator unit 5 serves as an ejection area having a number of ejection openings 4*y* (see FIG. 6 to FIG. 7) for ejecting ink droplets. Inside the passage unit 4 are formed a common ink passage (manifold channels 41 and sub manifold channels 41*a*) communicating to the opening 4*x*; and individual ink passages which extend from the outlets of a sub manifold channels 41*a* to an ejection openings 4*y*. As shown in FIG. 4, the sub manifold channels 41*a* are branched from the manifold channel 41 and extend in a direction parallel to the length of the head.

Next, the following details the structure of the filter unit 2, with reference to FIG. 3 and FIG. 5.

As shown in FIG. 3A, the filter unit 2 has a connect part provided between the joints 2*a* to 2*c* and the base 20 to connect the joints 2*a* to 2*c* with the base 20. The base 20 has the filter 2*f*, a first chamber 21 (a space upstream of the filter 2*f*), a filter chamber 29 (a space downstream of the filter 2*f*), a second chamber 22 communicating to the first chamber 21, a discharged passage 26*a*, and the like. The discharged passage 26*a* is a passage through which ink flows into (returns to) the sub tank 54. In the connect part are formed three connect passages 7*a*, 7*b*, and 7*c*. Of these, the connect passage 7*a* connects the joint 2*a* and the second chamber 22 of the base 20, the connect passage 7*b* connects the joint 2*b* and the later-described discharged passage 26*a*, and the connect passage 7*c* connects the joint 2*c* and a first liquid chamber 21 of the base. The top surfaces of the connect passages 7*a* to 7*c* are sealed by a flexible film. On the flexible film are stacked a metal plate whereby an excessive outward deflection of the flexible film is restrained. Although illustration is omitted, an upper wall defining each of these connect passages 7*a* to 7*c* has a structure similar to that of the later-mentioned layered member having the flexible film 27 and the metal plate 28 (see FIG. 3B).

The space in the base 20 is divided into two spaces by a parting plate 23 vertically provided. These two spaces are shown on the left and right side of the parting plate 23 in FIG. 3B which shows the base 20 assuming that the head 1 is disposed to face downward the under surface 4*a* of the passage unit 4. These first and second chambers 21 and 22 are horizontally aligned with the parting plate 23 therebetween. When viewing a cross section of these first and second chambers 21 and 22, which is a vertical plane parallel to the direction of aligning these chambers 21 and 22 (hereinafter, simply referred to as alignment direction), the vertical size of the cross section is longer than the horizontal size. The parting plate 23 serves as one of the side walls of each of the chambers 21 and 22, and the layered member including the flexible film 27 and the metal plate 28 serves as another side wall on the opposite side of the each of the chambers 21 and 22. With the layer of the metal plate 28, excessive outward deflection of the flexible film 27 is restrained, and the flexible film 27 is kept from being directly exposed to an external force. Note that illustration of the layered member including the flexible film 27 and the metal plate 28 is omitted in FIG. 3A.

The first and second chambers 21 and 22 are in communication with each other through a communicating passage 23*x* structured by a substantially ellipsoidal through hole formed on the parting plate 23, as shown in FIG. 3A. The communicating passage 23*x* is disposed at end portions of the chambers 21 and 22, which are opposite to those close to the joints 2*a* to 2*c*. In other words, the communicating passage 23*x* is disposed in the upper portions, at the ends of the chambers 21 and 22 relative to the lengths thereof.

Figure 5A:
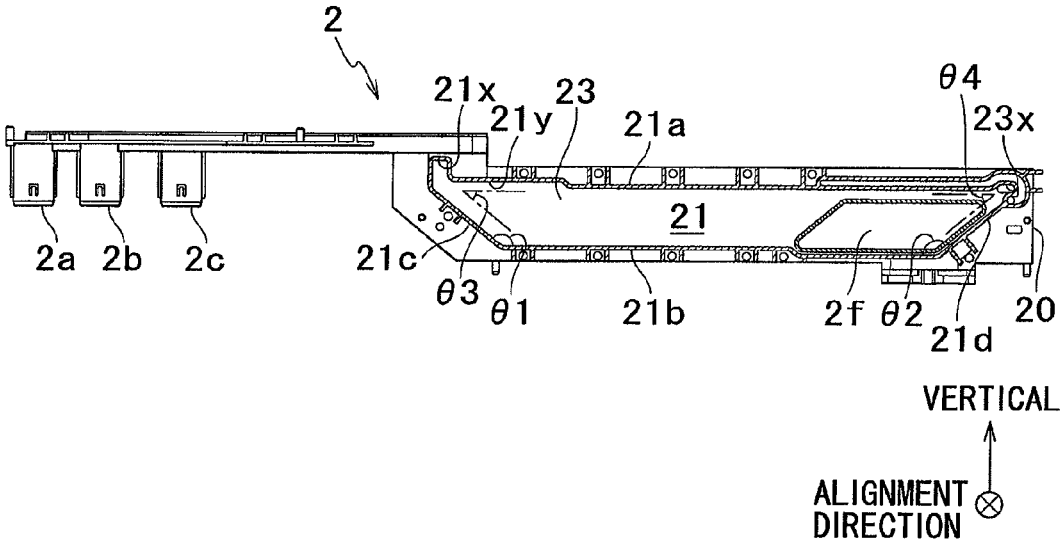
FIG. 5A is a partial cross sectional view of a first chamber of a filter unit.

As shown in FIG. 5A, the first chamber 21 is surrounded by an upper wall 21*a* and a bottom wall 21*b* which extend in a horizontal direction, and side walls 21*c* and 21*d* which are tilted from the vertical directions. When viewed from the alignment direction, the first chamber 21 has a space in an inverted trapezoid shape. The layered member (see FIG. 3B) of the flexible film 27 and the metal plate 28 is disposed to face the parting plate 23 relative to the alignment direction. The flexible film 27 is attached to the respective leading ends of the walls 21*a* to 21*d* so as to cover the first chamber 21.

Figure 5B:
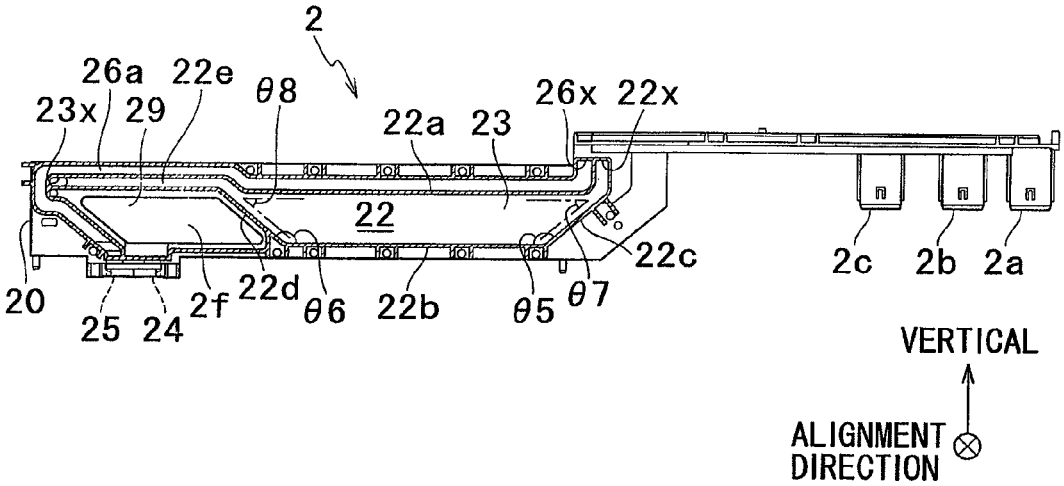
FIG. 5B is a partial cross sectional view of a second chamber of the filter unit.

As shown in FIG. 5B, the second chamber 22 is surrounded by an upper wall 22*a* and a bottom wall 22*b* which extend in a horizontal direction, and side walls 22*c* and 22*d* which are tilted from the vertical directions. When viewed from the alignment direction, the second chamber 22 has a main space in an inverted trapezoid shape and a passage 22*e* connecting thereto. The passage 22*e* is a thin and narrow passage extended from the upper portion of the side walls 22*d* along the length of the base 20. The passage 22*e* is positioned higher than the main space of the second chamber 22, relative to the vertical directions. Below the passage 22*e* is formed a filter chamber 29 over a partition wall. Around the second chamber 22 and the filter chamber 29 is a ventilation passage 26*a* which is formed so as to wall at least the upper left portion of the second chamber 22 and the filter chamber 29 in FIG. 5B. The layered member (see FIG. 3B) of the flexible film 27 and the metal plate 28 is disposed to face the parting plate 23, relative to the alignment direction. The flexible film 27 is attached to: the respective leading ends of the walls 22*a* to 22*d*; and the respective leading ends of the side walls defining the passage 22*e*, the filter chamber 29, and the ventilation passage 26*a*, thereby covering the second chamber 22, the filter chamber 29, and the ventilation passage 26*a*. Note that the ventilation passage 26*a* is a passage for leading ink discharged from the reservoir 33*x* to the outside of the head 1.

As shown in FIG. 5A, the respective angles θ1 and θ2 of the side walls 21*c* and 21*d* with respect to the bottom wall 21*b* of the first chamber 21 are both blunt angles (e.g., 140 degree), and the respective angles θ3 and θ4 of the side walls 21*c* and 21*d* with respect to the upper wall 21*a* are both substantially 40 degree. Further, as shown in FIG. 5B, the respective angles θ5 and θ6 of the side walls 22*c* and 22*d* with respect to the bottom wall 22*b* of the second chamber 22 are both blunt angles (e.g., 140 degree), and the respective angles θ7 and θ8 of the side walls 22*c* and 22*d* with respect to the upper wall 22*a* are both substantially 40 degree.

As described, the angles at the bottom of the chambers 21 and 22 are both blunt angles. Therefore, the ink flowing in the chambers 21 and 22 along the length does not stagnate at the angles at the bottom of the each chamber and smoothly flows substantially in a horizontal direction. Air bubbles having flown into the chambers 21 and 22 also smoothly flow substantially in a horizontal direction along with the ink and hardly stay in the chambers 21 and 22.

The first chamber 21 is in communication with the connect passage 7*c* (see FIG. 3A) through an opening 21*x* formed at an upper portion of an end portion of the first chamber 21 close to the joints 2*a* to 2*c*, relative to the length of the first chamber 21. In an area nearby the opening 21*x* on the upper wall 21*a* is a recess 21*y* as show in FIG. 5A. The recess 21*y* extends towards the downstream of an ink flow at the time of recording. The recess 21*y* temporarily captures air bubbles in the ink having flown into the first chamber 21. This prevents the air bubbles from moving to the filter 2*f*.

The main space of the second chamber 22 is in communication with the connect passage 7*a* (see FIG. 3A) through an opening 22*x* formed at an upper portion of an end portion of the second chamber 22 close to the joint 2*a* to 2*c*, relative to the length of the chamber 22. Further, as shown in FIG. 5B, the main space of the second chamber 22 is in communication with the passage 22*e* at the upper portion of the end portion opposite to the opening 22*x*. The passage 22*e* has a through hole at its leading end, which communicates to the communicating passage 23*x*. When viewed from the alignment direction, the filter chamber 29 has a shape of a parallelogram which is surrounded by the bottom wall of the passage 22*e* and the side walls 22*d* of the main space or the like of the second chamber 22. The shape of the filter chamber 29 is substantially the same as that of the filter 2*f*, and is slightly larger than the filter 2*f*.

An area of the parting plate 23 where the filter 2*f* is disposed is opened. To this opening is attached the filter 2*f*. The filter 2*f* is a meshed plate-like member for capturing foreign materials in the ink. This filter 2*f* is vertically provided along the surface of the parting plate 23. Thus, the first chamber 21 and the filter chamber 29 are in communication via the filter 2*f*. The filter 2*f* filtrates the ink flowing from the first chamber 21 to the filter chamber 29. The filter chamber 29 is also in communication with the through hole 31*a* of the reservoir unit 3, via the through hole 24 formed on the bottom partition.

As shown in FIG. 5A, the filter 2*f* is positioned closer to the bottom wall 21*b* than the upper wall 21*a*, in the first chamber 21. Between the filter 2*f* and the upper wall 21*a* is formed a gap which is bigger than the gap formed between the filter 2*f* and the bottom wall 21*b*. The bigger gap is for capturing the air bubbles having flown into the first chamber 21 and prevent the air bubbles from reaching the filter 2*f*. The communicating passage 23*x* is in a position within the first chamber 21, which position is obliquely above the filter 2*f* and is between the filter 2*f* and the upper wall 21*a* relative to the vertical directions.

As shown in FIG. 5B, the ventilation passage 26*a* is in communication with the connect passage 7*b* (see FIG. 3A) via an opening 26*x* formed at an end portion close to the joints 2*a* to 2*c*. The ventilation passage 26*a* is also in communication with the through hole 31*b* of the reservoir unit 3 via a through hole 25 at the bottom.

Thus, the present embodiment having the structure described above includes: a first passage extending from the joint 2*a* to the joint 2*c* via the connect passage 7*a*, the second chamber 22, the first chamber 21, and the connect passage 7*c*; a second passage which branches off from the first passage, at the first chamber 21 and communicates to the joint 2*b* via the filter 2*f*, the filter chamber 29, the reservoir 33*x*, the recess 32*x*, the ventilation passage 26*a*, and the connect passage 7*b*; and a supply passage which branches off from the second passage, at the leading ends of each branch passage of the reservoir 33*x*, and supplies ink to the ejection opening 4*y* via the filter 72, the manifold channel 41 and the sub manifold channel 41*a*, as is schematically shown in FIG. 6A to FIG. 7B. Note that the filter 2*f* serves as a branch point at which the second passage branches off from the first passage.

Figure 6A:
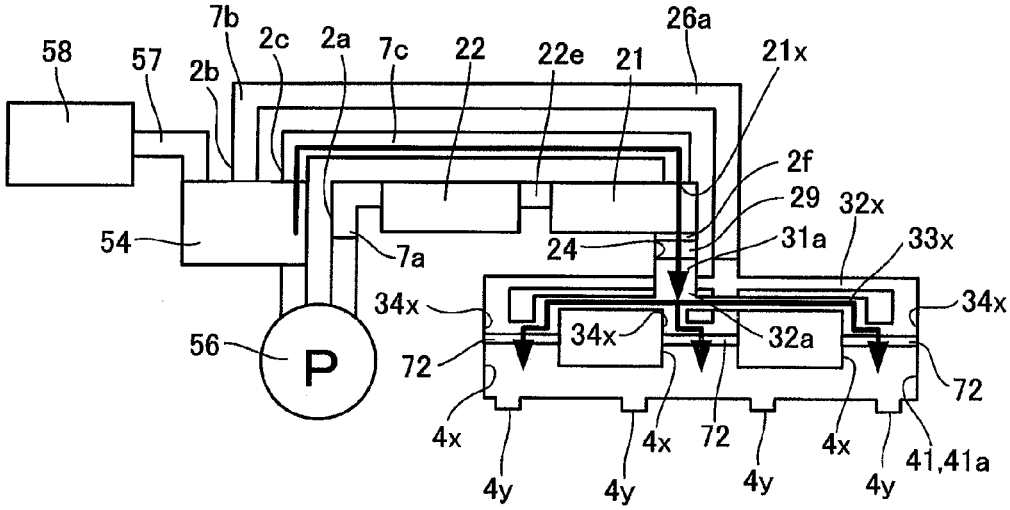
FIG. 6 is a schematic view of an ink passage extending from the inkjet head to the ink supply unit, and includes FIG. 6A indicating with an arrow how ink flows in the inkjet head shown in FIG. 1 at a time of recording, and FIG. 6B indicating with an arrow how the ink flows in the inkjet head of FIG. 1 at a time of circulation purging.

Next, the following describes, with reference to FIG. 6A, how the ink flows in the inkjet head 1 at the time of recording. When recording is executed, the controller 501 switches the open/close valves 62 and 63 to the open state, and the open/close valve 61 to the closed state. This causes spontaneous flow of ink from the main tank 58 to the filter unit 2 via the sub tank 54, with consumption of the ink to form an image.

The arrows in FIG. 6A shows a flow of ink during recording, in which the ink flows from the sub tank 54 to the passage unit 4. When recording is executed, the ink in the sub tank 54 is supplied to the filter unit 2 via the joint 2*c*. In the filter unit 2, the ink flow mostly in the passage shown in FIG. 6A. First, the ink having flown in from the joint 2*c* flows in the connect passage 7*c* (see FIG. 3A) and is supplied to the first chamber 21 via the opening 21*x*. The ink is then headed towards the filter 2*f* in the chamber 21. The ink filtrated through the filter 2*f* reaches the filter chamber 29 and flows into the reservoir unit 3 via the through hole 24. Then, the ink having flown into the reservoir unit 3 via the through hole 31*a* flows into the reservoir 33*x* via the through hole 32*a*. Then, the ink is branched at the reservoir 33*x* and supplied to the passage unit 4 via the through holes 34*x* (see FIG. 3A). The ink having been supplied from the reservoir unit 3 to the passage unit 4 via the openings 4*x* flows into the manifold channels 41 and the sub manifold channels 41*a*, and is distributed to each of the individual ink passages. Then, the ink is ejected from the ejection openings 4*y* when the corresponding actuator unit 5 is driven (see FIG. 4, FIG. 6A).

As described, at the time of recording, the ink in the sub tank 54 is supplied to each ejection opening 4*y*, sequentially via a part of the first passage (from the joint 2*c* to the filter 2*f*), a part of the second passage (from the filter 2*f* to the leading end of each branch passage of the reservoir 33*x*), and the supply passage.

Figure 6B:
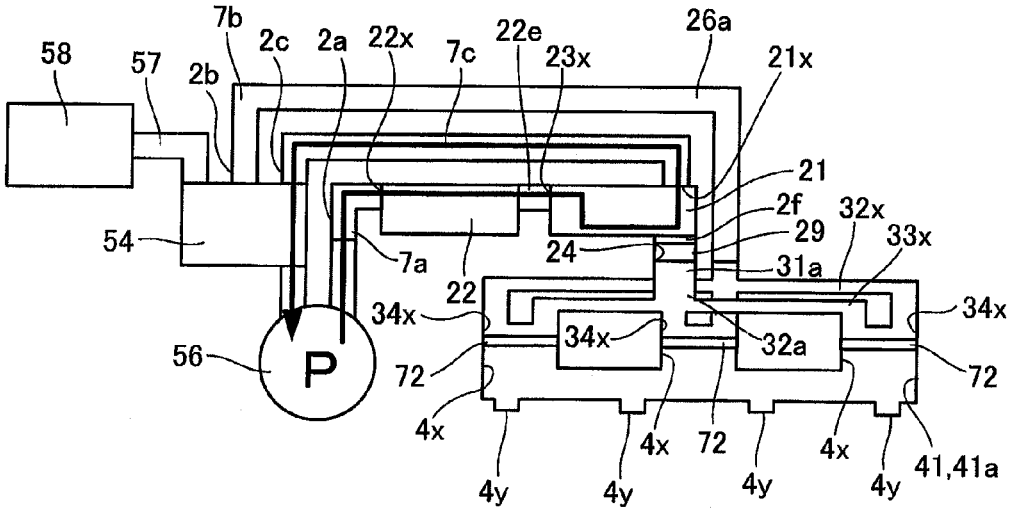

Next, the following describes, with reference to FIG. 6B, how the ink flows in the inkjet head 1 at the time of circulation purging. The circulation purging is a process of forcedly discharging foreign materials on the filter 2*f* along with the ink, by supplying the ink to the filter unit 2. This process is executed for the purpose of dissolving or preventing clogging of the filter 2*f*. To start the circulation purging, the controller 501 switches only the open/close valve 62 to the open state, switches the open/close valves 61 and 63 to the closed state, and activates the pump 56. After a predetermined period, the pump 56 is stopped to end the circulation purging. Note that the passage resistance between the filter 2*f* and the joint 2*c* is less than that between the filter 2*f* and the ejection opening 4*y*. Therefore, although the joint 2*a* is in communication with the ejection openings 4*y*, the ink does not leak from the ejection openings 4*y* during the circulation purging. Note that, when the controller 501 drives the pump while the open/close valve 61 is in the open state, the circulation purging and the later-described inter-filter purging are executed at the same time. While the circulation purging and the inter-filter purging are executed at the same time, the amount of ink flowing in the purging areas decreases, because the entire passage resistance drops if the drive condition of the pump is the same. Thus, to ensure sufficient ink flow in the purging routes, the drive condition of the pump is preferably changed to increase the amount of ink flowing, when the circulation purging and the inter-filter purging are executed at the same time.

The arrow in FIG. 6B shows a flow of ink during circulation purging, in which the ink flows from the sub tank 54 back to the sub tank 54 via the filter unit 2. As described below, the ink flows in the first passage from the joint 2*a* towards the joint 2*c*. When the controller 501 activates the pump, the ink in the sub tank 54 starts to flow into the filter unit 2 via the joint 2*a*. The ink having flown into the filter unit 2 passes the connect passage 7*a* (see FIG. 3A), and is supplied to the main space of the second chamber 22 via the opening 22*x*. The ink in the main space then flows towards the passage 22*e*, and reaches the through hole 23*x* at the end portion of the passage 22*e*. After that, the ink having flown into the first chamber 21 via the through hole 23*x* flows towards the opening 21*x* along the surface of the filter 2*f* in the first chamber 21, from the opening 21*x* to the connect passage 7*c* (see FIG. 3A), and is discharged to the sub tank 54 via the joint 2*c*. This flow of ink along the surface at the upstream of the filter 2*f* removes the foreign materials thereon.

Figure 7A:
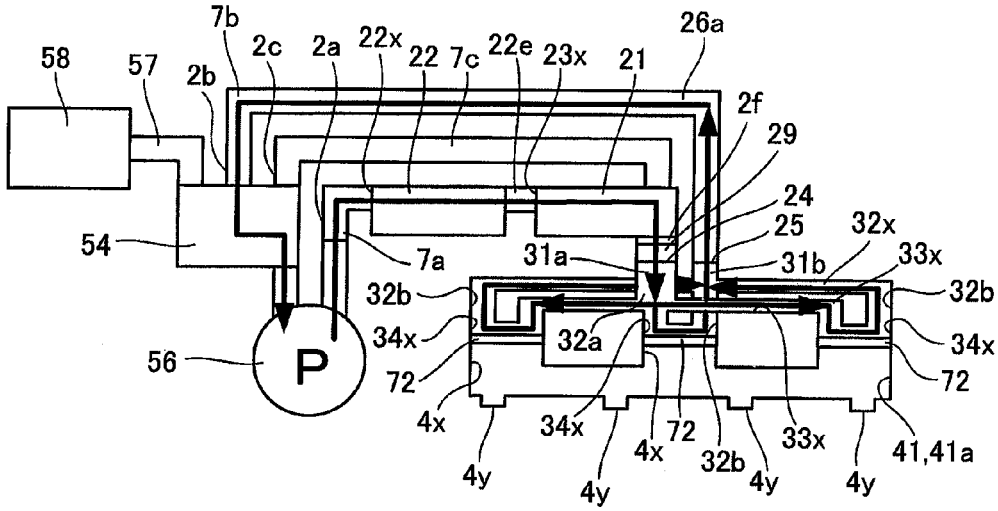
FIG. 7 is a schematic view of an ink passage extending from the inkjet head to the ink supply unit, and includes FIG. 7A indicating with an arrow how the ink flows in the inkjet head shown in FIG. 1 at a time of inter-filter purging, and FIG. 7B indicating with an arrow how the ink flows in the inkjet head shown in FIG. 1 at a time of nozzle purging.

Next, the following describes, with reference to FIG. 7A, how the ink flows in the inkjet head 1 at a time of inter-filter purging. The inter-filter purging is a process for removing foreign materials in the passage between the filter 2*f* of the filter unit 2 and the filter 72 disposed between the reservoir unit 3 and the passage unit 4. In the process, the ink is supplied to the passage between the two filters 2*f* and 72 to forcedly discharge foreign materials in the passage along with the ink. At the start of the inter-filter purging, the controller 501 switches the open/close valve 61 to the open state, switches the open/close valves 62 and 63 to the closed state, and activates the pump 56. After a predetermined period, the pump 56 is stopped to end the inter-filter purging. Note that the passage resistance between the leading end of each branch passage of the reservoir 33*x* and the joint 2*b* is less than the passage resistance between the leading end of each branch passage of the reservoir 33*x* and the ejection opening 4*y*. Therefore, although the joint 2*a* is in communication with the ejection openings 4*y*, the ink does not leak from the ejection openings 4*y* during the inter-filter purging.

The arrows FIG. 7A show a flow of ink during the inter-filter purging, in which the ink flows from the sub tank 54 back to the sub tank 54 via the filter unit 2 and the reservoir unit 3. As described below, the ink flows from the joint 2*a* to the first passage. The ink is then branched off and flows into the second passage through the filter 2*f*, and heads towards the joint 2*b*. When the controller 501 activates the pump, the ink in the sub tank 54 starts to flow into the filter unit 2 via the joint 2*a*. The ink having flown into the filter unit 2 reaches the through hole 23*x* via a route similar to that of the circulation purging. The ink having flown into the first chamber 21 via the through hole 23*x* passes the filter 2*f* and reaches the filter chamber 29. Then, the ink flows into the reservoir unit 3 via the through hole 24. The ink having flown into the reservoir unit 3 via the through hole 31*a* flows into the reservoir 33*x* via the through hole 32*a*. The ink is then branched at the reservoir 33*x* and reaches immediately above the filter 72 (see FIG. 3A).

Then, the ink flows towards the leading ends of the branch passages of the reservoir 33*x*. From the leading ends of the branch passages, the ink flows in a direction away from the filter 72; i.e., in an upward direction towards the recess 32*x*. Then, the ink flows to the recess 32*x* via the through hole 32*b*, and passes the through hole 31*b* to reach the ventilation passage 26*a* via the through hole 25. The ink having reached the ventilation passage 26*a* flows into the connect passage 7*b* (see FIG. 3A) through the opening 26*x*, and is discharged to the sub tank 54 from the joint 2*b*.

Figure 7B:
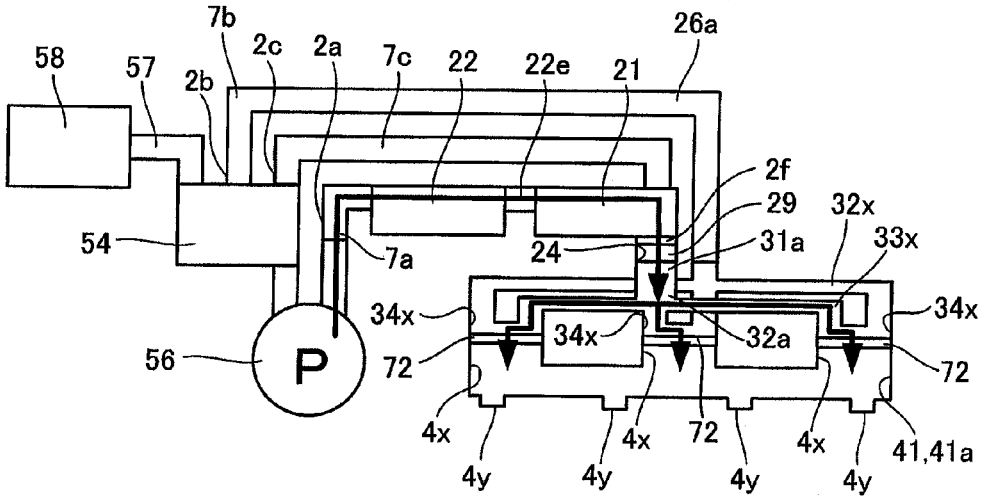

Next, the following describes, with reference to FIG. 7B, how the ink flows in the inkjet head 1 during the nozzle purging. The nozzle purging is a process of forcedly ejecting ink from the ejection openings 4*y* by supplying the ink to the passage unit 4. This process is for dissolving or preventing thickening of ink in the ejection openings 4*y* of the passage unit 4. Through the nozzle purging, the ink ejection performance of each ejection opening 4*y* is recovered. At the start of nozzle purging, the controller 501 switches all the open/close valves 61 to 63 to the closed state, and activates the pump 56. After a predetermined period, the pump 56 is stopped to end the nozzle purging.

The arrows of FIG. 7B shows a flow of ink during the nozzle purging, in which the ink flows from the sub tank 54 to the ejection openings 4*y* via the filter unit 2, the reservoir unit 3, and the ink passage in the passage unit 4. As described below, the ink flows from the joint 2*a* into the first passage, branched off at the filter 2*f* and flows towards the second passage, and branches into supply passages at the leading ends of the branched passages of the reservoir 33*x* to head towards the ejection openings 4*y*. When the controller 501 activates the pump, the ink inside the sub tank 54 starts to flow into the filter unit 2 through the joint 2*a*. The ink having flown into the filter unit 2 flows into the reservoir unit 3 via a route similar to that of the inter-filter purging. After the ink flows into the reservoir unit 3, the ink flows as is the case of the recording.

With the above described three different purging processes, removal of foreign materials such as air bubbles is executable separately at the upstream and downstream of the filter 2*f* and those of the filter 72. The circulation purging and the inter-filter purging causes the ink to flow through the entire filter unit 2 or the reservoir unit 3, which is advantageous in terms of preventing thickening of the ink not relevant to recording.

For the purpose of more suitably removing foreign materials in each area of the ink passage, the controller 501 is structured to execute the above described purging processes at the following timings.

Figure 8A:
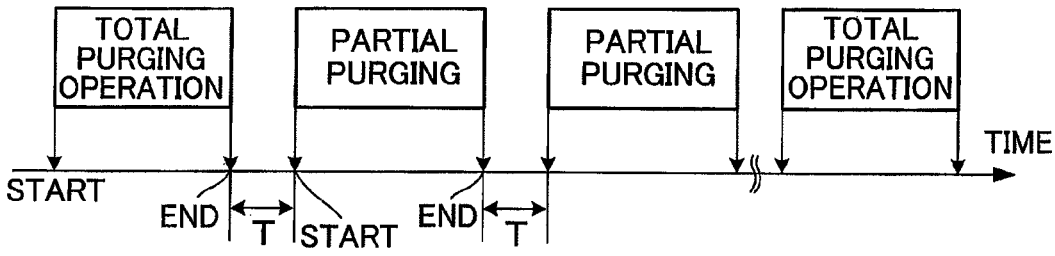
FIG. 8A to FIG. 8C are each a timing chart showing timings of executing circulation purging, inter-filter purging, and nozzle purging.

As shown in FIG. 8A, the controller 501 separately executes a total purging operation and a partial purging operation. The total purging operation includes the circulation purging, the inter-filter purging and the nozzle purging. The partial purging operation includes the circulation purging and the inter-filter purging, but not the nozzle purging. In the total purging operation, the controller 501 first starts the circulation purging at a time point t1 shown in FIG. 8B. Then, the inter-filter purging is started at a time point t2, after which the circulation purging is ended at a time point t3. The inter-filter purging is ended at a time point t4 which is after the time point t3. At the same time, the nozzle purging is started. The nozzle purging is then ended at a time point t5.

The total purging operation has the following characteristics (1) to (3): (1) The circulation purging, the inter-filter purging, and the nozzle purging are started in this order. Thus, the above total purging operation starts purging sequentially from the upstream to the downstream areas of the ink passage: i.e., with the filters 2*f* and 72 as the border lines, purging is started sequentially in the order of (a) an area upstream of the filter 2*f*, (b) an area between the filter 2*f* and the filter 72, and (c) an area from the filter 72 to the ejection opening 4*y*. In other words, the purging starts for the upstream before the purging for the downstream for each filter. If this sequence is reversed, and the downstream of the filter is purged before the upstream, the air bubbles at the upstream is accumulated in the filter. This may deteriorate the flow of ink from the upstream to the downstream. With the above characteristic (1) however, the air bubbles at the upstream are removed before the purging for the downstream. Therefore, air bubbles are less likely to be accumulated at the filter when the purging is executed for the downstream. Thus, the ink smoothly flows from the upstream to the downstream through the filter. As a result, foreign materials are suitably removed from the downstream as well. Further, removing air bubbles from the upstream of the filter before removing air bubbles in the downstream, restrains clogging on the filter by the air bubbles. Therefore, time required for the purging to remove foreign materials at the downstream is shortened.

(2) The circulation purging ends at a time point between the start and the end of the inter-filter purging. In other words, the circulation purging and the inter-filter purging are both executed during a period between the time points t2 and t3. Then, the inter-filter purging is executed alone during a period between time points t3 and t4. The passage subjected to the inter-filter purging has a higher passage resistance than that of the passage subjected to the circulation purging. This may cause the ink to partially flow into the passage unit 4 and damage the meniscus. With the above characteristic (2) however, the passage resistance during the period between the time points t2 to t3 is made lower than that during the period between the time points t3 and t4. Therefore, the filter 2*f* is prevented from being exposed to an excessive pressure. Thus, the possibility of the above described problem is reduced. By temporarily executing the circulation purging and the inter-filter purging at the same time, smooth transition from the circulation purging to the inter-filter purging. When the inter-filter purging is executed alone, the flow amount in the passage between the filters is increased as compared to the period during which the circulation purging is executed at the same time. Accordingly, foreign materials at the downstream of the filter 2*f* is powerfully removed.

The drive condition for the period of the inter-filter purging is adjusted so that the flow amount is maximized to the extent that the meniscus is not destroyed. When compared to the drive condition for the circulation purging, the pump output is raised or reduced depending on the cases. The difference in the pump output is based on the difference between the passage resistance of the passage from the leading ends of the branch passages of the reservoir 33*x* to the ejection openings 4*y* and the passage resistance of the passage leading to the joint 2*b*. As described, the pump output is adjusted for each period.

(3) The nozzle purging is started alone immediately after the end of the inter-filter purging. This way foreign materials at the downstream of the filter 72 are powerfully discharged. Especially, thickened ink inside the ejection openings 4*y* are powerfully discharged. By starting the nozzle purging immediately after the end of the inter-filter purging, the time taken for the total purging operation is reduced.

In the circulation purging, driving of the pump is started after completion of the control for switching the valves. When the inter-filter purging is started, the drive condition of the pump is changed after the control for switching the valves for the inter-filter purging is completed. The volume of ink flowing into the second passage is small until the valves are switched and the pump output is raised. This however, prevents inflow of the ink into the supply passage which is caused by an impact from the inflow of the ink into the second passage. Meanwhile, when the valves are switched for the nozzle purging, the pump output is further raised. After the valves are switched, the ink floods into the downstream of the filter 72 at a high pressure. This contributes to reduction of the time taken for the purging.

Figure 8B:
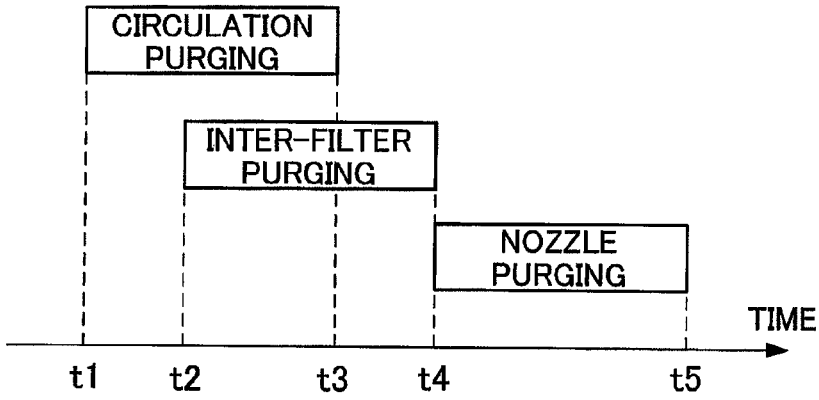
Figure 8C:
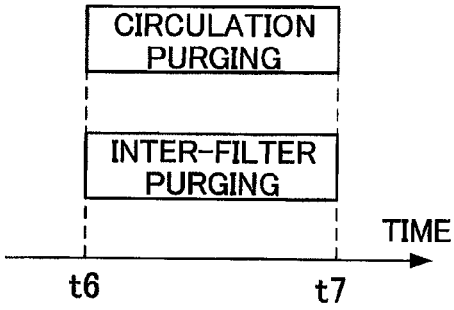

When the partial purging operation is executed, the controller 501 starts the circulation purging and the inter-filter purging at the same time at a time point t6 and end them at the same time at a time point t7, as shown in FIG. 8C. This way, the partial purging operation agitates the ink inside the passage while avoiding ejection of ink from the ejection openings 4*y* or damages to the meniscus in each opening 4*y*. Further, the entire operation is completed in a short period, because the circulation purging and the inter-filter purging are started and ended at the same time.

The controller 501 has a timer for measuring the time elapsed after completion of the total purging operation or the partial purging operation. The controller 501 executes the partial purging operation upon determining that a predetermined time T has elapsed since the end of the total purging operation as shown in FIG. 8A, based on a measurement result of the timer. The controller 501 then repeats the partial purging operation every time the time T is elapsed. Further, when a predetermined period elapses after the previous total purging operation, the next total purging operation is executed.

As described, after the total purging operation is executed, the controller 501 repeats the partial purging operation, and then executes the next total purging operation. This is because of the following reason. Once the total purging operation is executed to remove the foreign materials such as air bubbles on and around the filter, there is no need for removing the foreign materials for a while. However, the ink staying in the ink passage may be thickened in the above areas (a) and (b). For this reason, the partial purging operation is executed periodically, after the total purging operation. This restrains the ink from thickening in the above areas (a) and (b).

When a certain amount of time elapses from the end of the total purging operation, there will be a growth of air bubbles in the ink and the ink inside the ejection opening 4*y* is dried. For this reason, the controller 501 executes the next total purging operation, when a predetermined period elapses from the end of the previous total purging operation, thereby removing the foreign materials such as air bubbles having been grown or the thickened ink. The next total purging operation may be executed after the partial purging operation is executed a certain number of times, instead of executing the same after a predetermined period is elapsed. Further, the partial purging operation may be executed at a random timing, instead of periodically executing the same.

Thus, in the above is described a suitable embodiment of the present invention. The present invention however is not limited to the above described embodiment, and may be altered in various ways.

For example, in the above embodiment, the total purging operation starts and ends at the timings shown in FIG. 8B. The timings for ending each purging operation may be different from the above embodiment, provided that the purging is started in the sequence of (a), (b), and (c). The circulation purging may end at the same time as the start of the inter-filter purging or before the start of the inter-filter purging. Alternatively the circulation purging may end at the same time as the end of the inter-filter purging or after the end of the inter-filter purging. Further, the end of the inter-filter purging may be before the start of the nozzle purging, or after the end of the nozzle purging.

For example, in the total purging operation, the period during which only the inter-filter purging is executed is not necessary if the foreign materials such as air bubbles are removed within a period during which the circulation purging and the inter-filter purging are both executed. After the period of executing the both circulation purging and the inter-filter purging, the nozzle purging is executed. The drive condition may be changed to increase the pump output, for the purpose of maximizing the amount of ink flowing in the second passage to the extent that the meniscus is not damaged. The drive condition may be changed to further increase the pump output, when there is transition to the nozzle purging. As described, the pump output is controlled so as to rise step by step, with the changes in the type of purging; i.e., from the circulation purging at the beginning to the nozzle purging executed at last. Such a control of the pump is relatively easy, and the total purging operation is completed in a short time.

Note that the steps of switching the valves and pump output are the same as those of the embodiment described hereinabove. This decreases the impact generated by an inflow of ink into the second passage at the start of the inter-filter purging, and reduces the time taken for the purging.

Further, in the partial purging operation of the above embodiment, the circulation purging and the inter-filter purging start and end at the same time. However, as in the case of the total purging operation, the inter-filter purging may start during the circulation purging in the partial purging operation. This way, the ink flows smoothly from the upstream to the downstream of the filter 2*f* when the inter-filter purging is executed as in the case of the total purging operation. Therefore, foreign materials at the downstream of the filter 2*f* are suitably removed. This is effective in cases where foreign materials are likely to accumulate at the upstream of the filter 2*f*, in the period elapsed after the total purging operation or the partial purging operation.

Further, the structure of the ink supply unit 50 is not limited to the structure of the above embodiment, provided that the structure allows the ink to be supplied from the joint 2*a* and discharged from the joint 2*b* or 2*c*. For example, the ink supply unit 50 may be structured so that the ink discharged from the joint 2*b* or 2*c* is directly supplied to the joint 2*a*, without going through the sub tank 54.

Further, the above embodiment is an exemplary application of the present invention to an inkjet head which ejects ink from the nozzles. The application of the present invention however is not limited to such an inkjet head. For example, the present invention is applicable to: a droplet ejection head which ejects a conductive paste to a substrate to form a fine circuit pattern, a droplet ejection head which ejects an organic light emitting material to the substrate to form a high-precision display; and a droplet ejection head which ejects an optical plastic to the substrate to form a microscopic electronic device such as an optical wave guide device.

What is claimed is:

1. A recording apparatus, comprising:

a recording head having one or more ejection openings from which liquid is ejected; a liquid supply unit which supplies liquid to the recording head; and a supply control unit which controls the liquid supply unit, wherein the recording head includes:

a liquid supply portion and first and second discharge portions;

a first passage connecting the supply portion and the first discharge portion;

a second passage which branches off from the first passage and communicates to the second discharge portion;

a supply passage which branches off from the second passage and which supplies the liquid to the ejection openings; and a first filter disposed nearby a position at which the second passage branches off from the first passage, which filtrates the liquid flowing from the first passage to the second passage, and wherein the supply control unit controls the liquid supply unit so as to start a second liquid flow forming operation after a first liquid flow forming operation is started, the first liquid flow forming operation being a process which supplies the liquid from the supply portion to the first passage and discharge from the discharge portion; and the second liquid flow forming operation being a process which supplies the liquid from the supply portion to the first passage and discharge the liquid from the second discharge portion via the second passage.

2. The recording apparatus according to claim 1, wherein, after the supply control unit ends the first liquid flow forming operation, the liquid supply unit is controlled to end the second liquid flow forming operation.

3. The recording apparatus according to claim 1, wherein, the supply control unit controls the liquid supply unit so as to start the second liquid flow forming operation before the first liquid flow forming operation is ended.

4. The recording apparatus according to claim 1, wherein:

the recording head further includes a second filter which is disposed nearby a position at which the supply passage branches off from the second passage, and which filtrates liquid flowing into the supply passage from the second passage, wherein the supply control unit controls the liquid supply unit so as to start a third liquid flow forming operation after the second liquid flow forming operation is started, the third liquid flow forming operation being a process of causing the liquid to flow from the supply portion to the first passage and to flow into the supply passage via the second passage.

5. The recording apparatus according to claim 4, wherein the supply control unit controls the liquid supply unit so that the third liquid flow forming operation is started after the first and second liquid flow forming operations are both ended.

6. The recording apparatus according to claim 4, further comprising a timer which measures time having elapsed after the end of a total liquid flow forming operation in which the first to third liquid flow forming operations are sequentially started, wherein the supply control unit controls the liquid supply unit so that, until the elapsed time measured by the timer reaches a predetermined length, a partial liquid flow forming operation is executed in which the first and second liquid flow forming operations are executed but not the third liquid flow forming operation.

7. The recording apparatus according to claim 4, wherein the supply control unit starts the second liquid flow forming operation after the first liquid flow forming operation is started in the total liquid flow forming operation, and starts and ends the first and second liquid flow forming operations at the same time in the partial liquid flow forming operation.

8. The recording apparatus according to claim 1, wherein the liquid supply unit includes:

a liquid tank;

a pump which causes the liquid from the liquid tank to flow into the supply portion;

a first return passage which returns the liquid from the first discharge portion to the pump;

a second return passage which returns the liquid from the second discharge portion to the pump;

a first valve which performs switching between a state where no liquid flows in the first return passage and a state where the liquid flows in the first return passage; and and a second valve which performs switching between a state where no liquid flows in the second return passage and a state where the liquid flows in the second return passage, wherein the supply control unit controls the pump, and the first and second valves.

* * * * *